United States Patent [19]

Gruen

[11] 4,261,075

[45] Apr. 14, 1981

[54] WALL CLEANING VALVE STRUCTURE

[76] Inventor: Gustav Gruen, Vogelsberger Str. 71, 6474 Ortenberg-2, Lissberg, Fed. Rep. of Germany

[21] Appl. No.: 72,895

[22] Filed: Sep. 6, 1979

[30] Foreign Application Priority Data

May 15, 1979 [DE] Fed. Rep. of Germany ..... 2919484

[51] Int. Cl.[3] ..... A47L 5/14

[52] U.S. Cl. ..... 15/316 R; 137/494; 137/541; 251/63.6

[58] Field of Search ..... 15/316 R, 317, 405, 15/406, 407; 251/63.6; 137/494, 541

[56] References Cited

U.S. PATENT DOCUMENTS

| | | | |
|---|---|---|---|
| 1,393,548 | 10/1921 | Koudelka | 15/406 X |
| 2,374,977 | 5/1945 | Bunnell | 15/316 R |
| 3,126,909 | 3/1964 | Sweatt et al. | 137/494 X |
| 3,392,956 | 7/1968 | DeFrees | 251/63.6 X |
| 4,204,296 | 5/1980 | Reilly | 15/316 R |

*Primary Examiner*—Christopher K. Moore
*Attorney, Agent, or Firm*—W. G. Fasse; D. F. Gould

[57] ABSTRACT

A valve structure for cleaning purposes extends at least with part of its housing through a hole in a wall to be cleaned. Outlet nozzles in the housing extend so as to direct a cleaning medium substantially in parallel to or at a slight angle relative to the surface to be cleaned. The nozzles are so arranged that substantially a circle is covered by the resulting flow pattern. A valve closure is normally biassed into a nozzle closing position and may be lifted off the valve seat by the pressure of the cleaning medium flowing through the valve structure.

14 Claims, 2 Drawing Figures

WALL CLEANING VALVE STRUCTURE

Figure 1:
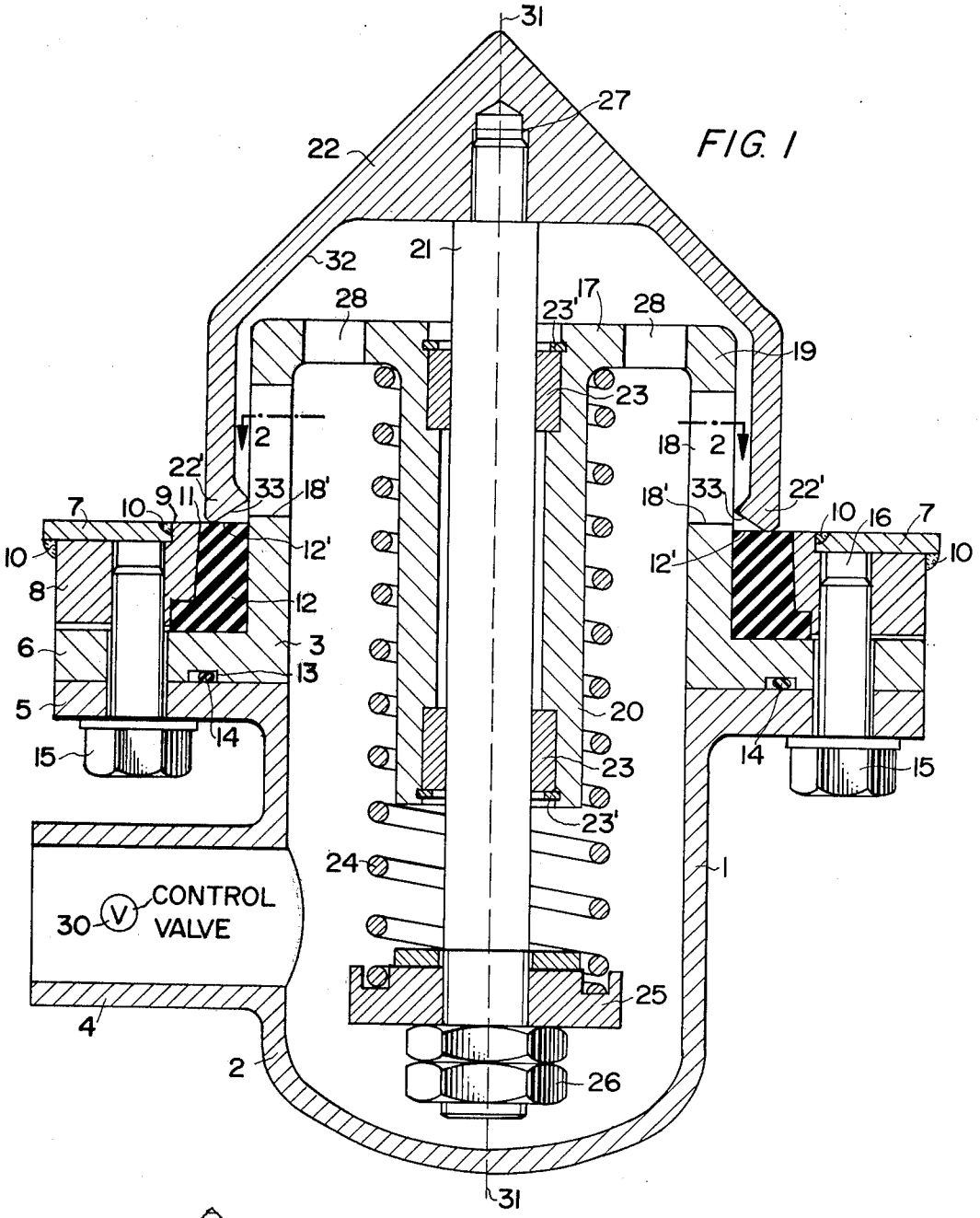

BACKGROUND OF THE INVENTION:

The invention relates to a wall cleaning valve structure, more particularly, for cleaning a wall by means of a gas or vapor under pressure. Such walls may be, for example, container walls which have been dirtied by anything held in the container, such as liquid remainders, for example, mineral oils or the like. The walls may be coated with dust or granular material or any other bulk type materials. For example, the inner surfaces of the walls of a bag emptying machine require cleaning from time to time. This also applies to the walls for any other equipment arranged for cooperation with the bag emptying machine, for example, dosing equipment for pigment materials in the paint industry or the like. Such cleaning may also be necessary in food processing machines especially where the food substances have a tendency to adhere to the walls of the handling equipment. The present valve structure extends through the wall to be cleaned and is normally permanently installed in the wall to be cleaned.

It is well known to clean the surface of equipment by means of a jet of a pressurized gas, for example, air or steam. Especially cleaning by means of steam or pressurized steam is employed for removing remainder layers formed by thermoplastic substances produced from mineral oils.

Cleaning devices used heretofore are either stationary or mobile. The respective jets of cleaning medium are either movable or also stationary. It is also known to employ mobile equipment normally having a long handle to one end of which a jet nozzle is attached. In this connection it should be noted that in addition to the air and steam jet devices certain cleaning jobs are performed by blasting solid particles onto the surface to be cleaned, for example, by special sandblasting equipment. Such solid particle blasting equipment may also be combined with the ejection of air or steam under pressure.

However, even the mobile equipment with fairly long handles is not always entirely satisfactory, for example, for cleaning the inner surfaces of equipment housings and material containers of all kinds. For instance, the components to be cleaned may be exposed alternately to materials of different kinds such as different pigments or the like. Even the mobile equipment cannot reach all areas to be cleaned by a cleaning medium depending on the size and shape of the housing or container. This lack of accessibility applies particularly to the housing of bag emptying machines. Such machines are used for opening bags containing soot, pigments, cement, synthetic materials and so forth and it is necessary that the bags are being opened substantially without any dust formation. In addition, the bags must be opened without any manual assistance and the bulk material removed from the bags must be transported separately from the empty bags. These requirements call for housing structures which are not easily accessible for cleaning purposes.

It is frequently required by the purchaser of such equipment that at least a light cleaning job may be accomplished when the machinery is to be changed from one type of material to another, for example, from pigment of one color to a pigment of another color so as to remove the material from the wall surfaces prior to the change over to handling another material. Stated differently, it is frequently necessary that a contamination of the new material to be handled by remainders of the old material is avoided with certainty without the creation of a dust or odor nuisance for the operating personnel or in the shop or factory space.

The stationary installation of directed jet nozzles may provide a certain improvement with regard to the accessibility of all surface areas, especially in machinery of the above kind. However, prior art stationary installations are not completely satisfactory. Normally, the rinsing or cleaning medium impinges on the surface to be cleaned at right angles in the form of a full jet or in the form of a tapered hollow cone, whereby the kinetic engergy of the jet becomes effective only on a relatively limited surface area. Thus, the cleaning efficiency is limited to the impinging zone and the kinetic energy of the jet is at least partially used up by the rebound of the cleaning medium.

OBJECTS OF THE INVENTION:

In view of the above it is the aim of the invention to achieve the following objects singly or in combination:

- to provide a cleaning valve structure for use in connection with gas or vapor under pressure which may be supplied onto the surface to be cleaned in a more efficient manner than heretofore, more particularly, to apply the cleaning medium or rinsing medium onto a substantially larger surface area than was possible heretofore while simultaneously utilizing the kinetic energy of the flow for the cleaning purpose;
- to construct the valve in such a manner that the cleaning medium under pressure is utilized for opening the valve when the pressure of the cleaning medium exceeds a certain pressure threshold and to close the valve when the pressure of the cleaning medium falls below a certain pressure threshold;
- to direct the cleaning medium substantially in parallel to the surface to be cleaned and onto a substantially circular surface area;
- to construct the cleaning valve according to the invention from several components all of which may be installed in a container wall from the outside thereof, whereby the components may be easily individually exchanged for maintenance or repair purposes;
- to construct the valve in such a manner that a closure member will be movable uniformly at a right angle relative to the surface to be cleaned thereby avoiding any canting of the closure member when it is repeatedly opened and closed; and
- to make the pressure of the cleaning medium and the biassing force of the closure member adjustable so that the opening and closing sequence or rather the opening frequency is adjustable.

SUMMARY OF THE INVENTION:

According to the invention the valve housing may be secured to the wall to be cleaned through a hole in the wall which is surrounded by a base flange. The base flange is provided with a shoulder against which a sealing member forming a valve seat is held by the valve housing. Thus, the elastically sealing valve seat is fixed in the radial as well as in the axial direction. The valve housing is provided with a first housing member having a cleaning medium inlet and a second housing member having cleaning medium outlets. The two valve housings are also preferably divided and connectable to each other by flanges which cooperate with the base flange secured to the wall to be cleaned. Preferably, both valve housing members have closed end walls. However, the end wall of the outlet housing member may be provided with additional outlet ports extending axially relative to the longitudinal axis of the valve structure and at right angles to the laterally extending outlet ports or nozzles. The flanges may be integral components of the valve housings or an intermediate flange connection may be provided. The outlet valve housing member is provided with the mentioned laterally extending exit nozzles. These exit nozzles may be located in a separate nozzle ring securable to the outlet housing member. The nozzle openings extend substantially in a plane which in turn extends in parallel to the longitudinal axis of the valve structure. Stated differently, the flow axis of each nozzle opening is located in a plane which extends perpendicularly to the longitudinal valve axis. Preferably, the nozzles are distributed substantially uniformly over the circumference of the nozzle ring. A closure member normally closes the outlet openings by resting under a biassing force against a valve seat preferably an elastic valve seat. The closure member has the shape of a cup which is axially movable away from and back into contact with the valve seat. However, it is also possible to provide the sealing along a rim of the closure member rather than as a sealing ring held between the flanges. The inlet means for the cleaning medium are adjustable so as to control the size of the passage area and thus the pressure and flow quantity of cleaning medium passing through the valve structure. The combination of the just described features makes it possible, provided that the compressible cleaning medium is supplied with sufficient pressure, to control the movement of the closure member. Thus, the closure member may be inside a housing the inner wall surfaces of which have to be cleaned, but the cleaning operation may be controlled from the outside by lifting the closure member off the valve seat through the pressure control valve. Incidentally, the valve seat may be formed against the inner container wall or against an elastic insert.

Figure 2:
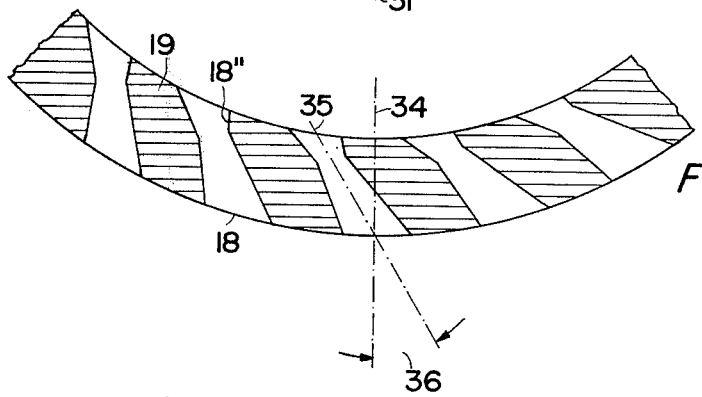

BRIEF FIGURE DESCRIPTION:

In order that the invention may be clearly understood, it will now be described, by way of example, with reference to the accompanying drawings, wherein:

FIG. 1 is a sectional view through a valve structure according to the invention whereby the sectional plane extends through the longitudinal axis of the valve structure; and FIG. 2 is a partial sectional view along section line 2—2 in FIG. 1.

DETAILED DESCRIPTION OF PREFERRED EXAMPLE EMBODIMENTS AND OF THE BEST MODE OF THE INVENTION:

The valve structure according to the invention as shown in FIG. 1 comprises a first or inlet valve housing member 1 and a second outlet valve housing member 3. The housing member 1 has an inlet portion 2 with an inlet port 4. A control valve 30 merely symbolically shown is arranged in the inlet port 4 and provided with a handle to be operated on the outside of a wall such as a container wall 7. Only a portion of the container is shown. The inner surface is to be cleaned.

The cross sectional inflow area may be controlled by the valve 30 which may, for example, be a needle valve for adjusting the pressure and flow quantity into the inlet portion 2 of the valve housing member 1. The housing member 3 comprises a plurality of outlet ports 18 arranged in the side wall of the outlet housing member 3. The side wall of the housing member 3 may be constructed as a separate nozzle ring 19 secured to the housing member proper by conventional means, for example, by threading. A base flange 8 is secured to the outside of the wall 7, for example, by welding seams 10. The base flange 8 is provided with threaded holes 16 into which screw bolts 15 extend to hold the flange 5 of the inlet housing member and flange 6 of the outlet housing member securely against the base flange 8.

The base flange 8 defines with its inwardly facing surface an opening 11 through which the outlet housing member 3 reaches to such an extent that the lower walls 18′ of the outlet nozzles 18 are about level with the inner surface of the wall 7. The inwardly facing wall of the base flange 8 is slightly slanted relative to the longitudinal axis 31 to thereby press the valve sealing member 12 against the outer portion of the housing member 3 and against the flange 6 of the housing member 3 for forming the valve seat 12′. The housing members 1 and 3 have substantially the same diameters.

The inwardly reaching part of the housing 3 has a diameter smaller than the inner diameter of a closure member 22 having the shape of a cup. The closure member 22 rests with its lower rim 22′ against the valve seat 12′. The outer diameter of the cylindrical portion of the closure member 22 has an outer dimension slightly smaller than the opening 11 defined by the base flange 8. Thus, the closure member 22 may be inserted through the opening 11 and the entire valve structure secured to the wall 7 from the outside thereof, whereby the threaded bolts 15 simultaneously make sure that the valve seat sealing member 12 is properly pressed into position. A further sealing ring 14 is held in a ring groove 13 to seal the two housing members relative to each other. The sealing member 12 provides a proper seal relative to the base flange 8 and simultaneously relative to the housing member 3. A radially outwardly extending flange of the sealing member 12 is clamped against the shoulder of the base flange 8 thereby preventing any axial displacement of the sealing member 12.

The outlet housing member 3 has an end wall 17. This end wall may be provided with exit holes 28 through which the cleaning medium under pressure may initially pass to impinge upon the inner slanted wall 32 of the closure member 22 thereby facilitating the uniform lifting of the closure member 22 off the valve seat 12′ without any canting.

The rim 22′ of the closure member 22 has a slanted surface 33 which extends with its upper inner edge to a level above the lower wall 18′ of the outlet nozzles 18, whereby the lifting of the closure member 22 is also facilitated when the cleaning medium under pressure impinges upon the slanted surface 33. An operating stem 21 is secured in a threaded hole 27 of the closure member 22 and extends coaxially with the axis 31 through a guide bushing 20 which is concentrically secured to of forms an integral part of the end wall 17 of the housing member 3. Slide bearings 23 are arranged inside the guide bushing 20 and held in position by snap rings 23′.

A biasing spring 24 movably surrounds the outer diameter of the guide bushing 20 and bears against a support plate 25 which is adjustable in its position by means of nuts threaded onto the lower free end of the valve stem 21. By adjusting the position of the plate 25 the biasing force of the spring may be increased or decreased as desired.

FIG. 2 shows the shape of the nozzle openings 18 which have a Venturi type restriction 18''. The nozzle openings 18 may extend radially, that is, in the direction of a radial line one of which is indicated at 34 or the flow direction indicated at 35 may enclose an angle 36 with the radial line 34. Preferably this angle is about 30°.

If desired, the outlet valve housing member 3 as well as the inlet valve housing member 1 and the nozzle ring 19 as well as the end wall 17 may be constructed as separate elements which are interconnected by conventional means such as threadings.

Regardless of the direction of the flow axis 35 of the plurality of Venturi nozzle openings 18, relative to the radial direction 34, these Venturi openings 18 are so located that the cleaning medium is diverted substantially at a right angle to the longitudinal axis 31 of the valve and thus onto the surface 7 to be cleaned, whereby a substantially circular flow distribution around the valve is accomplished. Moreover, the slanted surface 33 contributes to guiding the cleaning medium in the desired direction, whereby a highly efficient cleaning is achieved. Besides, the surface 7 does not need to be a plane surface. Rather, the present valve structure is just as efficient in its flow distribution over surfaces which are more or less concave or over surfaces which enclose an angle with each other.

As mentioned above, the axially directed outlet openings 28 greatly facilitate the proper guiding of the closure member 22 relative to the valve seat 12' so that any canting is avoided. Moreover, the rigid connection of the closure member 22 to the upper free end of the valve stem 21 in combination with the guiding at two spaced locations of the valve stem 21 by the sleeve bearings 23 assures that a uniform opening and closing along the rim 22' is accomplished. Stated differently, the flow distribution will be uniform all around the valve, thereby assuring a uniform cleaning of the area for the cleaning of which the present valve is designed.

Although above, the biasing force for the closure member 22 is accomplished by means of an adjustable biasing spring 23, it will be appreciated that a proper biasing force could also be accomplished by constructing the guide bushing and/or the valve stem 21 as a piston cylinder arrangement whereby the biasing could be controlled and/or adjusted by a pressure medium. By arranging the piston cylinder means which would operate as a stroke or pressure piston cylinder means centrally and axially inside the valve, it is possible to accomplish practically any desired stroke length. In any event, the piston cylinder arrangement could be connected to the end wall 17 as shown with respect to the guide bushing 20 or the respective arrangement could be secured inside the inlet housing member 1.

Incidentally, the above mentioned arrangement of the Venturi nozzle openings 18 results in an especially intensive and efficient cleaning operation, particularly if the Venturi openings are combined with the slanted location of the flow axis 35 as shown in FIG. 2. These Venturi restrictions 18'' in the nozzle openings 18 accelerate the cleaning medium and in addition the jets of cleaning medium are flared out so that a partial overlap of individual cleaning medium jets along their edges is accomplished, whereby it is assured that dead zones on the surface to be cleaned are avoided.

As mentioned, the inlet valve 30 is preferably a pressure controlling valve.

By preadjusting the valve 30 and thus the flow through quantity of the cleaning medium into the valve structure and the pressure of the cleaning medium, and by adjusting the biasing force of the spring 24 it is possible to control the opening frequency of the closure member 22.

Although the invention has been described with reference to specific example embodiments, it will be appreciated, that it is intended to cover all modifications and equivalents within the scope of the appended claims.

What is claimed is:

1. A valve structure having a longitudinal axis, for cleaning a surface of a wall, comprising first valve housing means (1) including flow inlet means (2, 4), second valve housing means (3) including flow outlet means (18) for directing a cleaning medium onto said surface to be cleaned, flange means (5, 6, 8) arranged for operatively connecting said valve structure to said wall so that at least a portion of said second valve housing means extends through a hole in said wall to such an extent that said flow outlet means are located adjacent said surface to be cleaned, valve closure means (22), means (20, 21, 24) movably securing said valve closure means (22) to said second valve housing means so that said flow outlet means are normally covered by said valve closure means in a sealing manner to prevent said cleaning medium from contacting said surface, and means for admitting cleaning medium under pressure into said flow inlet means whereby said valve closure means are lifted to permit cleaning medium to pass through said flow outlet means onto said surface to be cleaned.

2. The valve structure of claim 1, wherein said flange means comprise a ring flange secured to said wall substantially opposite said surface to be cleaned, and two housing flange means connected to said ring flange, said structure further comprising elastic valve seat sealing means (12) operatively arranged between said ring flange and one of said housing means for cooperation with said valve closure means when the latter are in the valve closing position.

3. The valve structure of claim 1, wherein said longitudinal valve axis extends substantially perpendicularly to said surface to be cleaned, wherein said flow outlet means comprise a plurality of nozzle openings each having a respective flow direction axis extending in a plane which in turn extends substantially perpendicularly to said longitudinal valve axis.

4. The valve structure of claim 3, wherein said second valve housing means has a wall portion, said nozzle openings being uniformly distributed in said wall portion of said second valve housing means, and wherein said flow direction axis of each nozzle opening includes an angle with a line extending radially relative to said longitudinal valve axis.

5. The valve structure of claim 1, further comprising threaded bolt means extending through said flange means for simultaneously operatively interconnecting said first and second housing means and for connecting the valve structure to said wall means.

6. The valve structure of claim 1, wherein said second valve housing means with said flow outlet means comprise an end wall extending substantially perpendicularly to said longitudinal valve axis, said end wall having cleaning medium passage means therein facing said valve closure means, whereby said valve closure means may be moved out of the closing position substantially without canting.

7. The valve structure of claim 1, wherein said means for movably securing said valve closure means to said second valve housing means comprise guide bushing means rigidly connected to said second valve housing means, rod means guided in said guide bushing means, said valve closure means being connected to one end of said rod means, and biasing means for said guide rod means for normally biasing said closure means into a valve closing position.

8. The valve structure of claim 7, wherein said biasing means comprise spring means operatively interposed between the other end of said guide rod means and one of said first and second valve housing means, and means at said other end of said guide rod means for adjusting the biasing force of said spring means.

9. The valve structure of claim 1, wherein said flow outlet means in said second valve housing means extend substantially radially relative to said longitudinal valve axis.

10. The valve structure of claim 1, wherein said flow outlet means in said second valve housing means have a substantially Venturi type nozzle shape.

11. The valve structure of claim 1, wherein said cleaning medium admitting means comprise valve means, especially needle valve means, operatively located in said flow inlet means.

12. The valve structure of claim 11, wherein said valve means are adjustable for adjusting the flow rate and pressure of said cleaning medium, said valve structure further comprising adjustable biasing means for said valve closure means, whereby said adjustable valve means in combination with said adjustable biasing means provide for an adjustment of the opening frequency of said valve closure means.

13. The valve structure of claim 1, wherein said valve closure means have a rim surface slanted at an angle relative to said longitudinal axis, said rim facing with its slanted surface said flow outlet means whereby the lifting of said valve closure means is facilitated.

14. The valve structure of claim 13, wherein said slanted rim surface directs a flow of cleaning medium toward said surface to be cleaned.

* * * * *